US005577956A

United States Patent [19]

Darjee

[11] Patent Number: 5,577,956

[45] Date of Patent: Nov. 26, 1996

[54] HOT METAL GRINDING

[75] Inventor: Dhiraj H. Darjee, Ballston Lake, N.Y.

[73] Assignee: Norton Company, Worcester, Mass.

[21] Appl. No.: 430,044

[22] Filed: Apr. 27, 1995

[51] Int. Cl.[6] ..... B24D 11/00

[52] U.S. Cl. ..... 451/539; 451/533; 66/202

[58] Field of Search ..... 51/297, 300; 66/190, 66/192, 193, 195, 196, 202, 84 A, 85 A; 451/533, 539

[56] References Cited

U.S. PATENT DOCUMENTS

| | | | |
|---|---|---|---|
| 3,176,437 | 4/1965 | Lanyon | 451/539 |
| 3,787,273 | 1/1974 | Okrepkie et al. | 451/539 X |
| 4,722,203 | 2/1988 | Darjee | 66/202 |
| 4,728,552 | 3/1988 | Jensen, Jr. | 451/533 X |

FOREIGN PATENT DOCUMENTS

| | | | |
|---|---|---|---|
| 45408 | 2/1982 | European Pat. Off. | 451/539 |
| 435897B1 | 4/1994 | European Pat. Off. . | |
| 90/02631 | 3/1990 | WIPO . | |

*Primary Examiner*—Timothy V. Eley
*Attorney, Agent, or Firm*—David Bennett

[57] ABSTRACT

A coated abrasive suitable for conditioning a freshly cast metal surface comprises a backing having a cyclic elongation at a temperature of 150° C. of less than 3%.

6 Claims, No Drawings

HOT METAL GRINDING

BACKGROUND OF THE INVENTION

This invention relates to the hot grinding of metal stock and specifically to an abrasive belt backing material adapted for use in hot grinding applications.

Continuous casting of slab, thin plate and strip has been expanding significantly in recent years with many companies, especially in the United States and in Europe developing proprietary positions in casting equipment and technologies. Typically the metal casting is ground after it has been cooled and can easily be handled. It has been pointed out however that this is not very logical since the metal, upon cooling, becomes rapidly covered with a coating of oxide and scale which can not readily be removed. Thus from a purely theoretical point of view a metal should be more easily ground when it is hot. Moreover the time taken for the cooling is essentially wasted. It has therefore been proposed to grind the metal when it is hot and suitable machinery and techniques for doing this are set out in European Patent Application 435,897.

However it is found that existing belts, though usable for such applications, fail prematurely as a result of backing failure at the temperatures encountered. It has now been found that this failure mode is often associated not with the wearing out of the abrasive but with excessive elongation of the belt during grinding, where the ambient temperature in the grinding environment can be several hundred degrees Centigrade. This elongation can make the tension on the belt vary and can result in slipping on the rolls on which it is carried or perhaps uneven pressure across the width of the belt where the expansion is uneven.

The present invention provides a coated abrasive belt built upon a backing that is particularly well adapted for the very difficult working conditions encountered in this application. As a result the working life is greatly extended and the quality of grinding is improved.

DESCRIPTION OF THE INVENTION

The present invention provides a coated abrasive belt adapted for use at elevated temperatures, (which for the purposes of this specification is understood to be above about 1000° C.), which comprises a backing material having a tensile strength in the machine direction of at least 750 lb/inch, (134 kg/cm), and a cyclic elongation of less than 3% at 100 lb/inch, (17.9 kg/cm), load at a temperature of 150° C. and deposited on said backing material an abrasive containing layer comprising abrasive grain and maker and size coats.

The "cyclic elongation" is the elongation of an abrasive belt after being cycled between extended and relaxed positions a prescribed number of times. In the test an "Instron" tester is used on a strip sample of the coated abrasive product that is 2.54 cm in width. The tester had an ininitial jaw opening at zero applied tensile force of 25.4 cm. The sample to be tested was equilibrated at the test temperature of 150° C. and then subjected to extension at a rate of 2.5 cm/minute until a force of 17.9 kg/cm was registered. At this point, the jaws reversed direction and closed at the same rate until the tensile force was reduced to 3.6 kg/cm. This cycling was automatically continued with contiuous reading of the jaw spacing and tensile force until several cycles had given the same jaw spacings for each value of tensile force, (about 20 cycles). The tensile force was then returned to zero. The maximum elongation noted in the final cycle is called the "cyclic elongation".

The backing material can be a woven fabric selected from the group consisting of plain, twill and sateen weaves or a stitch-bonded fabric of the type described in U.S. Pat. No. 4,722,203. The warp yarns preferably comprise a polyaramid fiber of at least 800 denier, and more preferably from about 800 to about 2000 denier. Preferably the denier and the distribution of the warp yarn are selected such that a total of at least about 16,000 denier/inch is achieved. The fill yarns can comprise polyamide or polyester yarns of at least 750 denier, and more preferably from about 800 to about 1200, and the construction has at least 25 warp and fill yarns per linear inch so as to achieve a total of 10,000 denier per inch and a tensile strength of at least 100 lb/inch. The preferred fill yarns are multifilament nylon more preferably a texturized nylon multifilament yarn.

In addition to the above-mentioned yarns it is often possible to use glass fiber yarns, particularly where these are wrapped, for example using a polyaramid such as Kevlar or a polyester.

While woven fabrics have been described above it is also possible to use stitch-bonded Malimo-type fabrics or certain warp knit fabrics adapted for weft insertion, (that is LIBA), provided the properties are adjusted to meet the above levels. Such adjustment is however not straightforward and the preferred products are those based on the weaves described above.

The preferred polyaramid warp yarns are preferably multifilament yarns and the fill yarns can be either monofilament yarns or textured or untextured multifilament yarns without significant detrimental effect.

Where the fill yarns are made from a polyester this is preferably a polyethylene terephthalate and more preferably a bright polyester. The more preferred yarns are however nylons, such as a polyaramid such as that sold by DuPont under the trademark "Kevlar", but more conventional nylons such as nylon 6; nylon 6,6; and nylon 6,12 can also be used. Particularly preferred nylons are texturized cordura nylons.

The most frequently selected weave is a simple 1×1 or, often more preferably 2, 3 or 4×1, with the 1×1 (plain) and 3×1 (twill) weaves being particularly preferred in woven constructions. The number of warp yarns in stitch-bonded or warp knit designs could be lower than the corresponding figure for a woven design and be correlated with the selection of machine gauges.

The preferred construction has at least as many warp yarns as fill yarns with at least 25 such as from about 30 to 35 warp yarns per inch being particularly preferred.

The backing is preferably treated with a saturant and backfill before being provided with the abrasive-containing layer. These may be selected from the formulations commonly used in the industry for heavy duty grinding belts.

The surface of the backing is preferably finished with a formulation containing a filler and a high temperature stable resin to impart sufficient heat resistance while at the same time permitting an appropriate level of flexibility to the belt for grinding applications. A preferred resin coating is a mixture of an epoxy resin, a phenolic resin and an acrylic resin applied in an amount that is from about 20 to about 150% of the fabric weight.

The treated backing can be provided with any suitable form of abrasive layer. Conventionally a maker coat of a resin is applied followed by a layer of abrasive grain. The resin layer is then cured at least sufficiently to retain the grains in place. A resin size layer is then applied over the abrasive layer to aid in maintaining the grain in place and often a supersize coat is applied that may contain grinding aids or other desirable additives. The resin employed in the maker and size coats can be any of those conventionally used in coated abrasives providing they are capable of withstanding the temperatures at which these products are to be used.

The abrasive grain can be any of those commonly used in coated abrasives such as for example alumina, silicon carbide and alumina/zirconia abrasives. Generally aggressive cutting grains such as sol-gel alumina derived abrasives are particularly advantageous in high temperature grinding applications. The grit sizes usually used are comparatively coarse since a fine finish is not as important at this early stage of the sheet metal production as consistency of thickness. Thus 24 to 60 grit sizes are most commonly useful in this application.

DESCRIPTION OF PREFERRED EMBODIMENTS

The following styles of backing constructions have been found to be effective in high temperature applications. They are used to indicate the kinds of products that are useful and not to imply any necessary limitation on the scope of the invention. In each case the warp yarn was 840 denier "Kevlar", a polyaramid fiber available under that trade name from DuPont Company. The weave, construction and the nature of the fill yarns was varied.

| | WEAVE | WARP YARN | FILL YARN | CONSTRUCTION |
|---|---|---|---|---|
| A | 1 × 1 Plain | 840 D Kevlar | 1000/192 D Bright Pester | 30 warp/inch 30 fill/inch |
| B | 1 × 1 Plain | 840 D Kevlar | 1000 D Text. Cordura Nylon | 32 warp/inch 26 fill/inch |
| C | 3 × 1 Twill | 840 D Kevlar | 1000/192 D Bright Pester | 30 warp/inch 30 fill/inch |
| D | 3 × 1 Twill | 840 D Kevlar | 1000 D Text. Cordura Nylon | 32 warp/inch 26 fill/inch |

The backings should have excellent stability at high temperatures and this implies an elongation at a temperature of 150° C. under a load of 17.9 kg/cm of less than about 3% for coated abrasive built upon such backings.

To further illustrate the invention two coated abrasive belts were constructed based on the B-type structure described above. Both were given the same saturant and backfill treatments using the following formulations:

| Saturant Formula | |
|---|---|
| V-1350, a phenolic resin available from Bendix Corp. | 55% |
| Water | 4.1% |
| SSXS, a viscosity reducer from Pilot Chemical Co., | 2.8% |
| Calfax DB-45, a wetting agent from Pilot Chem. Co. | 4.5% |
| Tamol 165, a dispersant available from Rohm & Haas | 1.8% |
| Red pigment | 2.8% |
| Nopco NDW, a defoamer available from Henkel Corp. | 0.5% |
| Nalco 2311, a defoamer available from Nalco Chem. Co. | 0.5% |
| A-1100 silane available from Union Carbide | 0.5% |
| Wollastonite filler | 27.5% |
| **Backfill Formula** | |
| 460X-80, a vinyl chloride copolymer available from B. F. Goodrich | 37.9% |
| CMD 35201, an epoxy resin available from Shell Co. | 15.0% |
| Calcium Carbonate filler | 33.7% |

-continued

| | |
|---|---|
| Nopco NDW, a defoamer available from Henkel Corp. | 3.0% |
| ASE 60, a thickener available from Rohm & Haas | 3.7% |
| Black dye | 2.0% |

The maker coat applied over the baking material prepared as indicated above was based on a phenolic resin/filler combination with minor amounts of water, dye, surfactant and penetration aids.

The size coat comprised the same phenolic resin base along with surfactants, dye, and cryolite filler.

In each case the fabric weight was 16 lb/ream, (236.8 gm/m$^2$); the saturant add-on weight was 14.2 lb/ream, (210 gm/m$^2$); the backfill add-on weight was 5.0 lb/ream, (74 gm/m$^2$); the maker weight was 30 lb/ream, (444 gm/m$^2$); and the total applied abrasive grain weight was 70 lb/ream, (1036 gm/m$^2$).

In one case the grain was a commercial alumina/zirconia grain sold under the registered trademark "Norzon" by Norton Company. In the other case the grain was a seeded sol-gel alumina abrasive used in Norton's "SG" product line. In both cases the grit was 24 grit.

The abrasive belts were tested for physical properties including the critical cyclic elongation test. The results are shown in Table 1 below.

TABLE 1

| PROPERTY | KEVLAR/NYLON PLAIN CONTINUOUS FILAMENT NORZON GRAIN | KEVLAR/NYLON PLAIN CONTINUOUS FILAMENT SG GRAIN |
|---|---|---|
| TEN. STR. | Warp 179 kg/cm Fill 21.1 kg/cm | Warp 161.1 kg/cm Fill 17.0 kg/cm |
| ELONG. AT BREAK | Warp 5.8% Fill 29.8% | Warp 4.91% Fill 20.1% |
| CYCLIC ELONGATION | 2.25% | 1.81% |
| PEEL ADH.* | 4.2 kg/cm | 3.9 kg/cm |

*Peel adhesion is a measure of the strength of the bond between the abrasive containing layer and the backing and therefore of the extent to which the grain will be retained on the belt during heavy duty grinding operations.

For the purposes of comparison a heavy duty stitch-bonded fabric, (polyester design, style 23-22H-3A), bearing "Norzon" abrasive grit commercially sold by Norton Co. under the designation E-825 showed an average cyclic elongation under the same conditions of 5.58%

From the above data it will be seen that effective coated abrasive belts can be provided for hot grinding conditions.

What is claimed is:

1. A coated abrasive belt having machine and transverse directions and adapted for use at elevated temperatures which belt comprises a backing material having a tensile strength in the machine direction of at least 134 kg/cm and a cyclic elongation of less than 3% at 17.9 kg/cm load at a temperature of 150° C. and, deposited on said backing material, an abrasive containing layer comprising abrasive grain and maker and size coats.

2. A coated abrasive belt according to claim 1 in which the backing material is selected from the group consisting of woven fabrics with a weave selected from plain, twill and sateen, stitch-bonded fabrics and weft-inserted fabrics.

3. A coated abrasive belt according to claim 2 in which the warp yarns are polyaramid yarns supplying a total denier per inch of at least 16,000.

4. A coated abrasive belt according to claim 2 in which the backing material has fill yarns selected from polyester and nylon.

5. A coated abrasive belt according to claim 2 in which the backing material comprises warp yarns and fill yarns and the number of fill yarns per inch is less than the number of warp yarns per inch.

6. A coated abrasive belt according to claim 1 comprising a backing material having an elongation at 150° C. under a load of 17.9 kg/cm of less than 2.5%.

* * * * *